US008206174B2

(12) United States Patent
Ko

(10) Patent No.: US 8,206,174 B2
(45) Date of Patent: Jun. 26, 2012

(54) HIGH FREQUENCY RECEPTACLE CONNECTOR WITH PLUG CONNECTOR DETECTING FUNCTION

(75) Inventor: Wen-Chih Ko, Hsin-Tien (TW)

(73) Assignee: Advanced Connectek Inc., Hsin-Tien, Taipei Hsien (TW)

( * ) Notice: Subject to any disclaimer, the term of this patent is extended or adjusted under 35 U.S.C. 154(b) by 0 days.

(21) Appl. No.: 12/876,282

(22) Filed: Sep. 7, 2010

(65) Prior Publication Data

US 2011/0281449 A1 Nov. 17, 2011

(30) Foreign Application Priority Data

May 17, 2010 (TW) ..... 99115660 A

(51) Int. Cl.
*H01R 3/00* (2006.01)

(52) U.S. Cl. ..... 439/489

(58) Field of Classification Search ..... 439/489, 439/188, 490, 630, 638, 660; 200/51.09, 200/51.1

See application file for complete search history.

(56) References Cited

U.S. PATENT DOCUMENTS

| | | | | |
|---|---|---|---|---|
| 5,674,085 | A * | 10/1997 | Davis et al. | 439/188 |
| 7,207,819 | B2 * | 4/2007 | Chen | 439/188 |
| 7,575,454 | B1 * | 8/2009 | Aoki et al. | 439/188 |
| 7,695,318 | B1 * | 4/2010 | Wang et al. | 439/607.01 |
| 7,736,184 | B1 * | 6/2010 | Wan et al. | 439/607.11 |
| 2007/0059959 | A1 * | 3/2007 | Chen | 439/188 |
| 2009/0061671 | A1 * | 3/2009 | Qin et al. | 439/188 |
| 2009/0111330 | A1 * | 4/2009 | Lin et al. | 439/638 |

* cited by examiner

*Primary Examiner* — Tulsidas C Patel
*Assistant Examiner* — Harshad Patel
(74) *Attorney, Agent, or Firm* — Alan Kamrath; Kamrath IP Lawfirm, PA

(57) ABSTRACT

A high frequency receptacle connector has an insulating housing, multiple first terminals, multiple second terminals, a shell and a plug detecting assembly. The first and second terminals are mounted on the insulating housing and capable of implementing USB3.0 protocol. The shell covers the insulating housing and terminals. The plug detecting assembly has a first detecting terminal and a second detecting terminal. The first detecting terminal is mounted on the insulating housing. The second detecting terminal is mounted on the insulating housing and selectively bends to contact or isolate from the first detecting terminal. The high frequency receptacle connector is capable of providing electric power under a power-saving mode of a PCB on which the high frequency receptacle connector is mounted.

14 Claims, 11 Drawing Sheets

HIGH FREQUENCY RECEPTACLE CONNECTOR WITH PLUG CONNECTOR DETECTING FUNCTION

BACKGROUND OF THE INVENTION

1. Field of the Invention

The present invention relates to a connector, and more particularly to a high frequency receptacle connector that is capable of detecting a corresponding plug connector of an electronic device to provide the electronic device with electric power.

2. Description of Related Art

Conventional Universal Serial Bus (USB) 2.0 connectors are used popularly in various electronic devices. Most computer peripherals are equipped with USB connectors. Because electronic devices are constantly developed to increase transmission speed thereof, the USB 2.0 protocol does not meet the current transmission speed requirement of new electronic devices. Therefore, the USB Implementers Forum set forth a new USB 3.0 protocol for higher data transmission speed.

The USB 3.0 protocol is compatible with the USB 2.0 protocol and provides theoretical 5 Gbps of data transmission speed.

Generally, USB receptacle connectors are mounted on printed circuit boards (PCBs), such as motherboards of desktops and laptops, and have a power terminal to provide a connected external electronic device with electric power. Current PCBs are designed to selectively switch to a power-saving mode. Under the power-saving mode, the PCB cuts off electric power supplied to devices or interface cards connected to the PCB. Of course, the electric power supplied to USB receptacle connectors is also cut off.

In particular aspects, some users require that the PCBs of the desktops and laptops under the power-saving mode still provide electric power to external electronic devices through USB receptacle connectors.

However, a conventional USB 3.0 receptacle connector is not designed to timely detect the insertion of a USB plug connector to start to provide electric power under the power-saving mode of a PCB on which the USB 3.0 receptacle connector is mounted.

To overcome the shortcomings, the present invention provides a high frequency receptacle connector with a plug connector detecting function to mitigate or obviate the aforementioned problems.

SUMMARY OF THE INVENTION

The main objective of the invention is to provide a high frequency receptacle connector that is capable of detecting a corresponding plug connector of an electronic device to provide the electronic device with electric power.

A high frequency receptacle connector in accordance with the present invention comprises an insulating housing, multiple first terminals, multiple second terminals, a shell and a plug detecting assembly. The first and second terminals are mounted on the insulating housing and capable of implementing USB3.0 protocol. The shell covers the insulating housing and terminals. The plug detecting assembly has a first detecting terminal and a second detecting terminal. The first detecting terminal is mounted on the insulating housing. The second detecting terminal is mounted on the insulating housing and selectively bends to contact or isolate from the first detecting terminal. The high frequency receptacle connector is capable of providing electric power under a power-saving mode of a PCB on which the high frequency receptacle connector is mounted.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
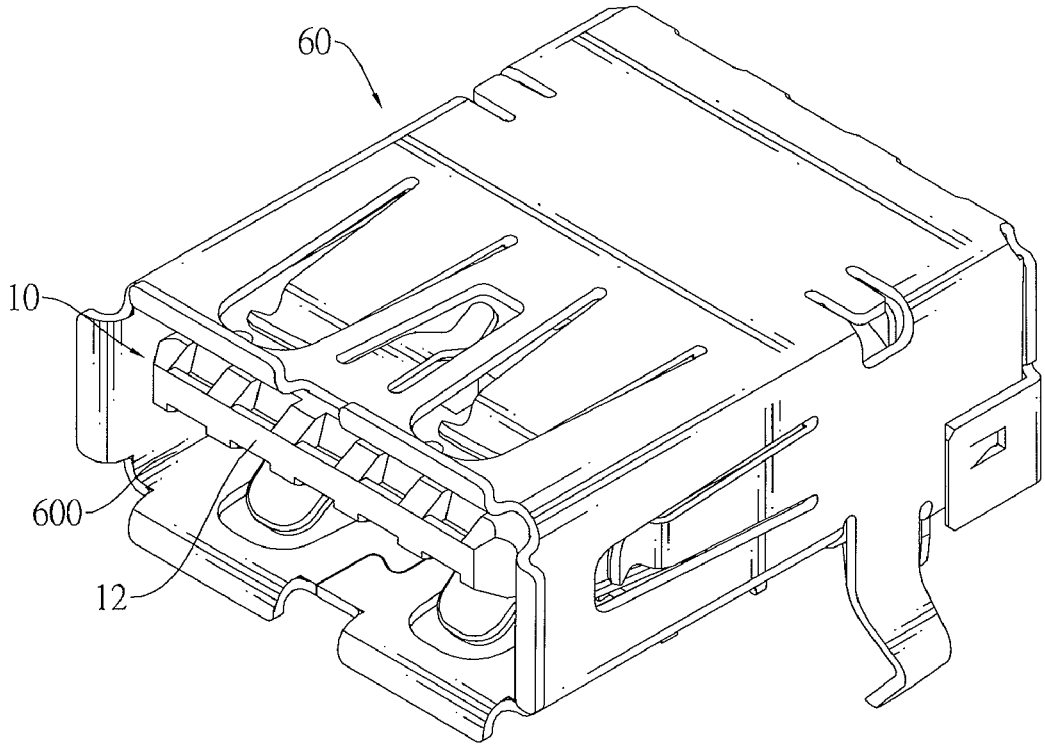
FIG. 1 is a top perspective view of a first embodiment of a high frequency receptacle connector with a plug connector detecting function in accordance with the present invention.
Figure 2:
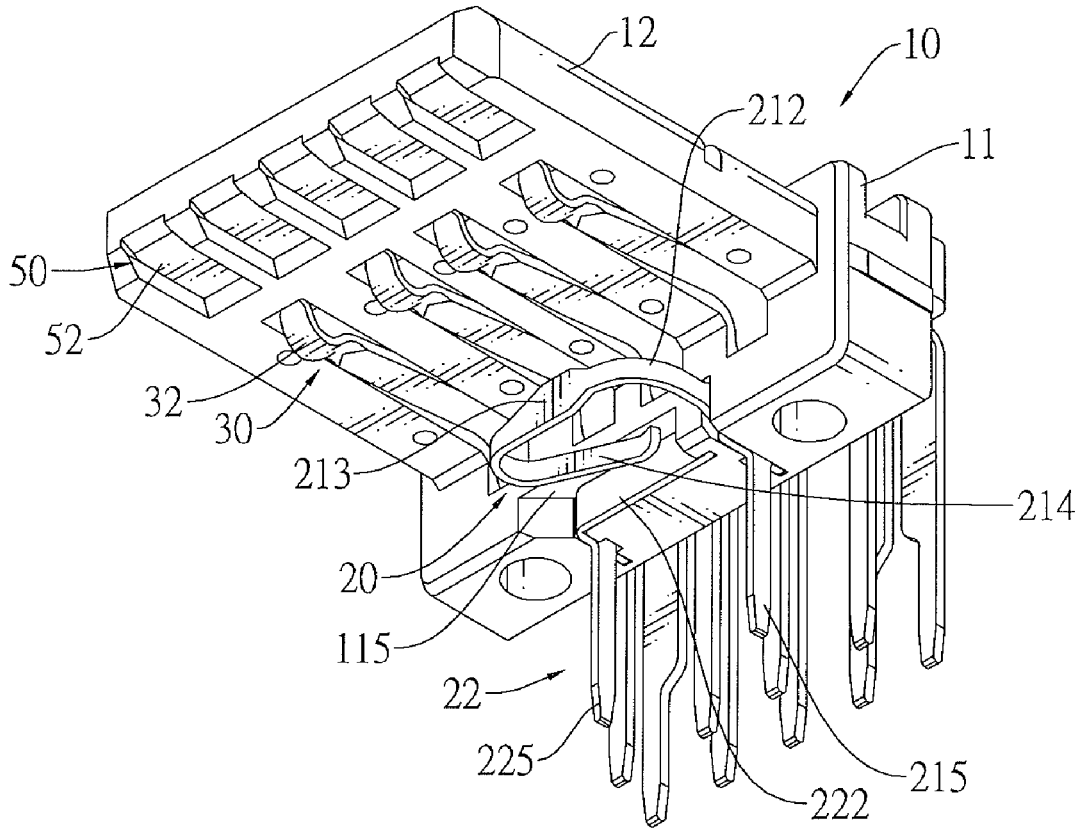
FIG. 2 is a bottom perspective view of the high frequency receptacle connector in FIG. 1 omitting the shell and the protecting bracket.
Figure 3:
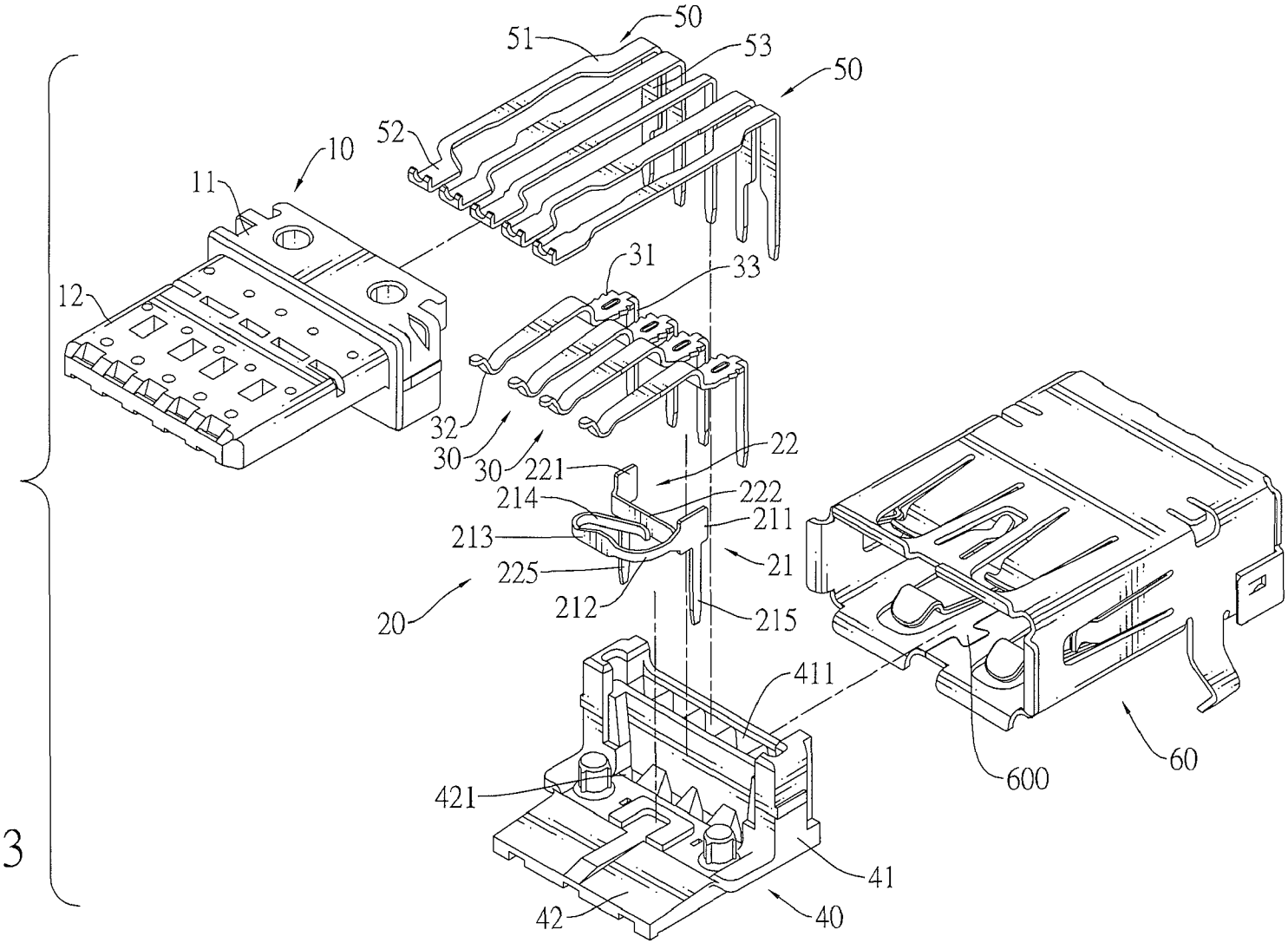
FIG. 3 is an exploded top perspective view of the high frequency receptacle connector in FIG. 1.
Figure 4:
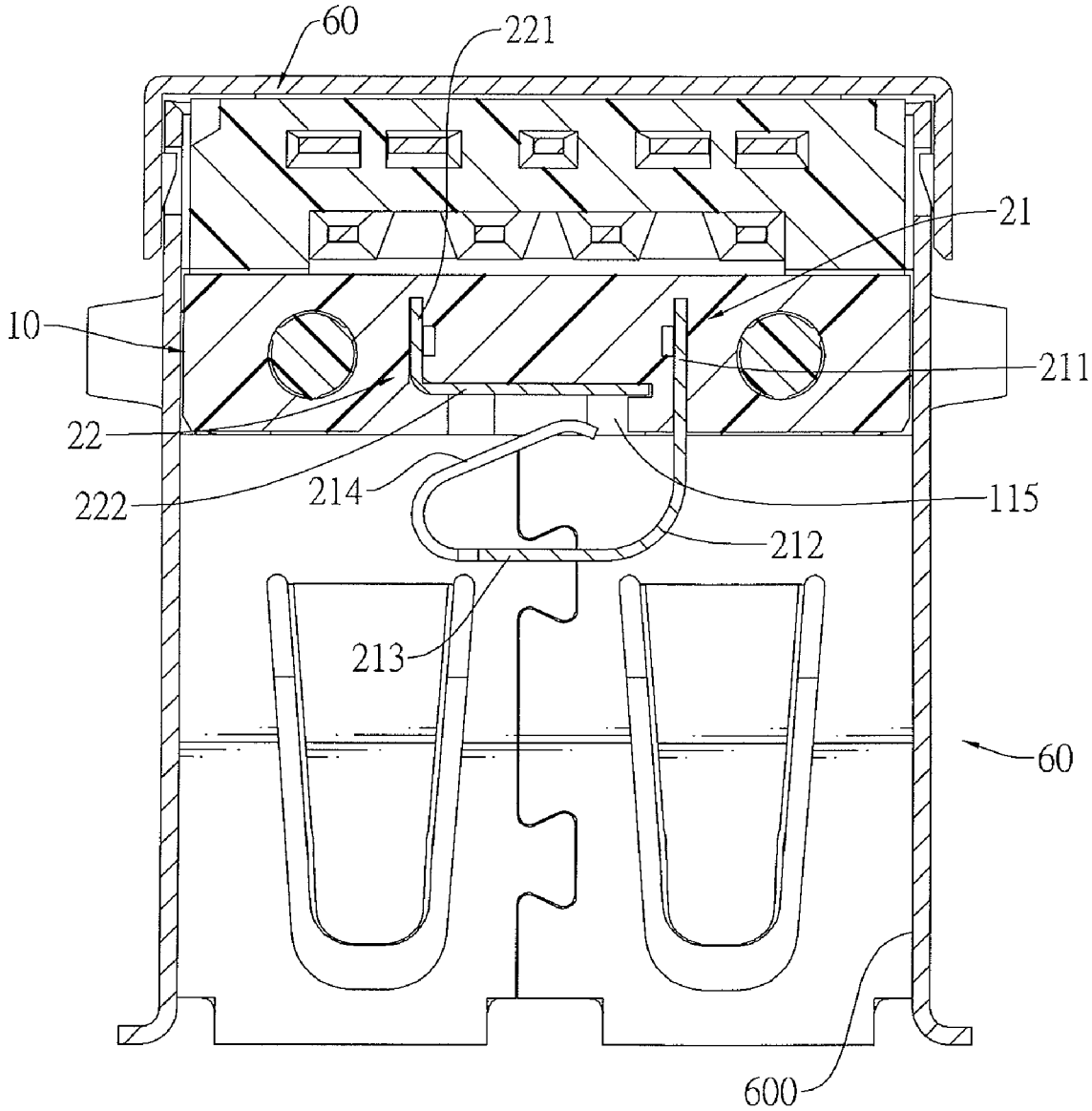
FIG. 4 is an exploded bottom perspective view of the high frequency receptacle connector in FIG. 1.

With reference to FIGS. 1 to 4, a first embodiment of a high frequency receptacle connector with a plug connector detecting function in accordance with the present invention may engage with a plug connector and comprises an insulating housing (10), multiple first terminals (30), multiple second terminals (50), a shell (60), a plug detecting assembly (20) and a protecting bracket (40).

The insulating housing (10) has a base (11) and a tongue (12).

The base (11) has a front and a bottom and may further have a mounting recess (115) defined in the front.

The tongue (12) is formed on and protrudes forward from the front of the base (11) and has a bottom surface.

The first terminals (30) are mounted through the insulating housing (10) and are capable of implementing USB 2.0 protocol. Each first terminal (30) has a first mounting section (31), a first contacting section (32) and a first soldering section (33).

The first mounting section (31) is mounted in the base (11) of the insulating housing (10).

The first contacting section (32) is formed on and protrudes forward from the first mounting section (31) and is mounted on the bottom surface of the tongue (12).

The first soldering section (33) is formed on and protrudes downward from the first mounting section (31).

The second terminals (50) are mounted on the insulating housing (10) and are capable of cooperating with the first terminals (30) to implement USB 3.0 protocol. Each second terminal (50) has a second mounting section (51), a second contacting section (52) and a second soldering section (53).

The second mounting section (51) is mounted in the base (11) of the insulating housing (10).

The second contacting section (52) is formed on and protrudes forward from the second mounting section (51) and is mounted on the bottom surface of the tongue (12).

The second soldering section (53) is formed on and protrudes downward from the second mounting section (51).

The shell (60) has a cavity (600) defined through the shell (60) and covering the insulating housing (10), the first terminals (30) and the second terminals (50). The cavity (600) has a front opening serving as a socket hole to receive a corresponding plug connector.

The plug detecting assembly (20) is mounted on the insulating housing (10) and has a first detecting terminal (22) and a second detecting terminal (21).

The first detecting terminal (22) is mounted securely on the insulating housing (10), may be mounted securely in the mounting recess (115) of the base (11), may be L-shaped and has a first mounting tab (221), a first contacting tab (222) and a first soldering tab (225). The first mounting tab (221) is mounted and embedded securely in the base (11) of the insulating housing (10). The first contacting tab (222) is formed on and protrudes substantially perpendicularly from the first mounting tab (221) and is mounted in the mounting recess (115). The first soldering tab (225) is formed on and protrudes downward from the first mounting tab (221).

The second detecting terminal (21) is resilient, is mounted securely on the insulating housing (10) and selectively bends to contact or isolate from the first detecting terminal (22) to activate a power supplying circuit of a PCB on which the high frequency receptacle connector is mounted. The activated power supplying circuit supplies electric power to the plug connector and an electronic device connected to the plug connector. For example, when a plug connector is inserted and engages with the high frequency receptacle connector, the second detecting terminal (21) is pressed and bent by a plug of the plug connector to contact or isolate from the first detecting terminal (22) to activate the power supplying circuit of the PCB on which the high frequency receptacle connector is mounted.

In the first embodiment, the second detecting terminal (21) is set in a predetermined configuration isolating and separating from the first detecting terminal (22) and is selectively pressed and bent to contact the first detecting terminal (22) by external force. The second detecting terminal (21) has a second mounting tab (211), a turning tab (212), a resilient arm and a second soldering tab (215).

The second mounting tab (211) is mounted and embedded securely in the base (11) of the insulating housing (10).

The turning tab (212) may be curved and is formed on the second mounting tab (211). The curved turning tab (212) increases the resilience of the second detecting terminal (21).

The resilient arm is formed on and protrudes from the turning tab (212), extends out of the base (10) and selectively bends to contact the first contacting tab (222) of the first detecting terminal (22). Preferably, the resilient arm is U-shaped and has a connecting tab (213) and a second contacting tab (214). The connecting tab (213) is formed on the turning tab (212) and protrudes away from the second mounting tab (211). The second contacting tab (214) is formed on the connecting tab (213) and protrudes toward the second mounting tab (211). The resilient arm selectively bends to make the second contacting tab (214) contact the first contacting tab (222) in a sufficient surface area instead of only a contacting point. The contact of the sufficient surface area between the first and second contacting tabs (222, 214) ensures that the electrically conductivity and signal transmission therebetween are fine.

Furthermore, the first mounting tab (221) of the first detecting terminal (221) and the second mounting tab (22) of the second detecting terminal (21) are located at a same embedded depth relative to the base (11) of the insulating housing (10).

The second soldering tab (215) is formed on and protrudes downward from the second mounting tab (211).

The protecting bracket (40) is mounted on the bottom of the base (11) of the insulating housing (10), may be L-shaped and may have a vertical member (41) and a horizontal member (42).

The vertical member (41) has multiple through holes (411) defined through the vertical member (41).

The horizontal member (42) is formed on and protrudes perpendicularly from the vertical member (41) and has multiple through holes (421) defined through the horizontal member (42). The through holes (411, 421) of the vertical and horizontal members (41, 42) respectively hold the first soldering sections (33), second soldering sections (53), first soldering tab (225) and second soldering tab (215).

Figure 5:
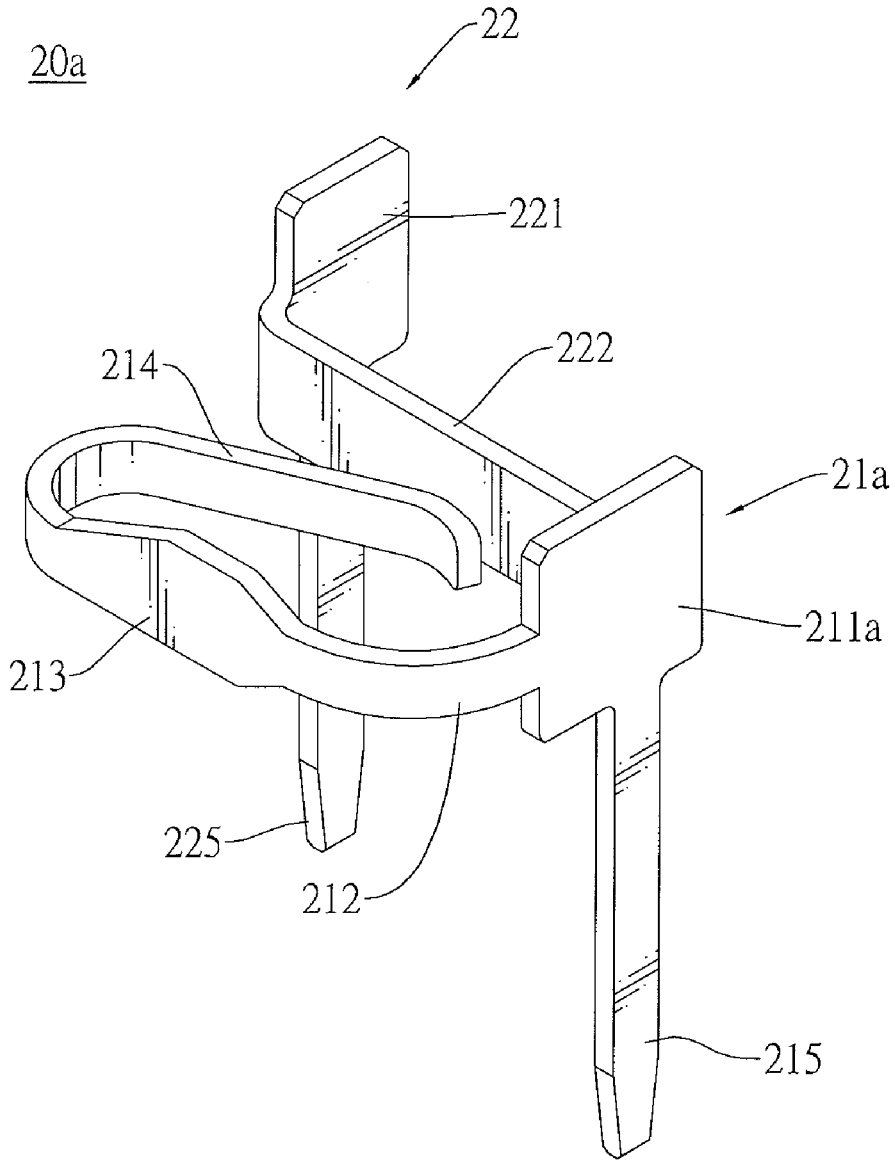
FIG. 5 is a perspective view of a plug detecting assembly of a second embodiment of a high frequency receptacle connector with a plug connector detecting function in accordance with the present invention.
Figure 6:
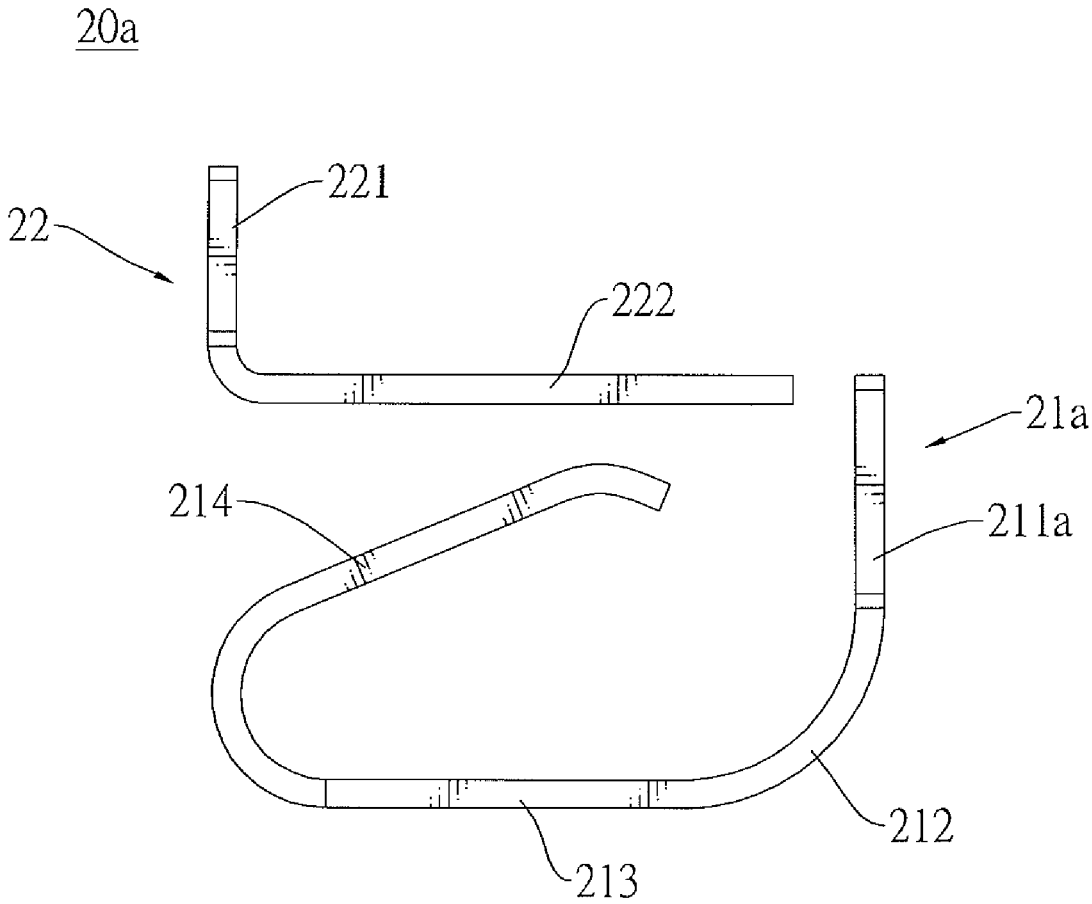
FIG. 6 is a top view of the plug detecting assembly of the high frequency receptacle connector in FIG. 5.

With further reference to FIGS. 5 and 6, a second embodiment of the high frequency receptacle connector in accordance with the present invention is similar to the first embodiment but modifies the second detecting terminal (21*a*) of the plug detecting assembly (20*a*). A second mounting tab (211*a*) of the second detecting terminal (21*a*) and the first contacting tab (222) of the first detecting terminal (22) are located at a same depth relative to the base (11) of the insulating housing (10). The second mounting tab (211*a*) of the second embodiment is shorter than that of the first embodiment so that the material cost is reduced.

Figure 7:
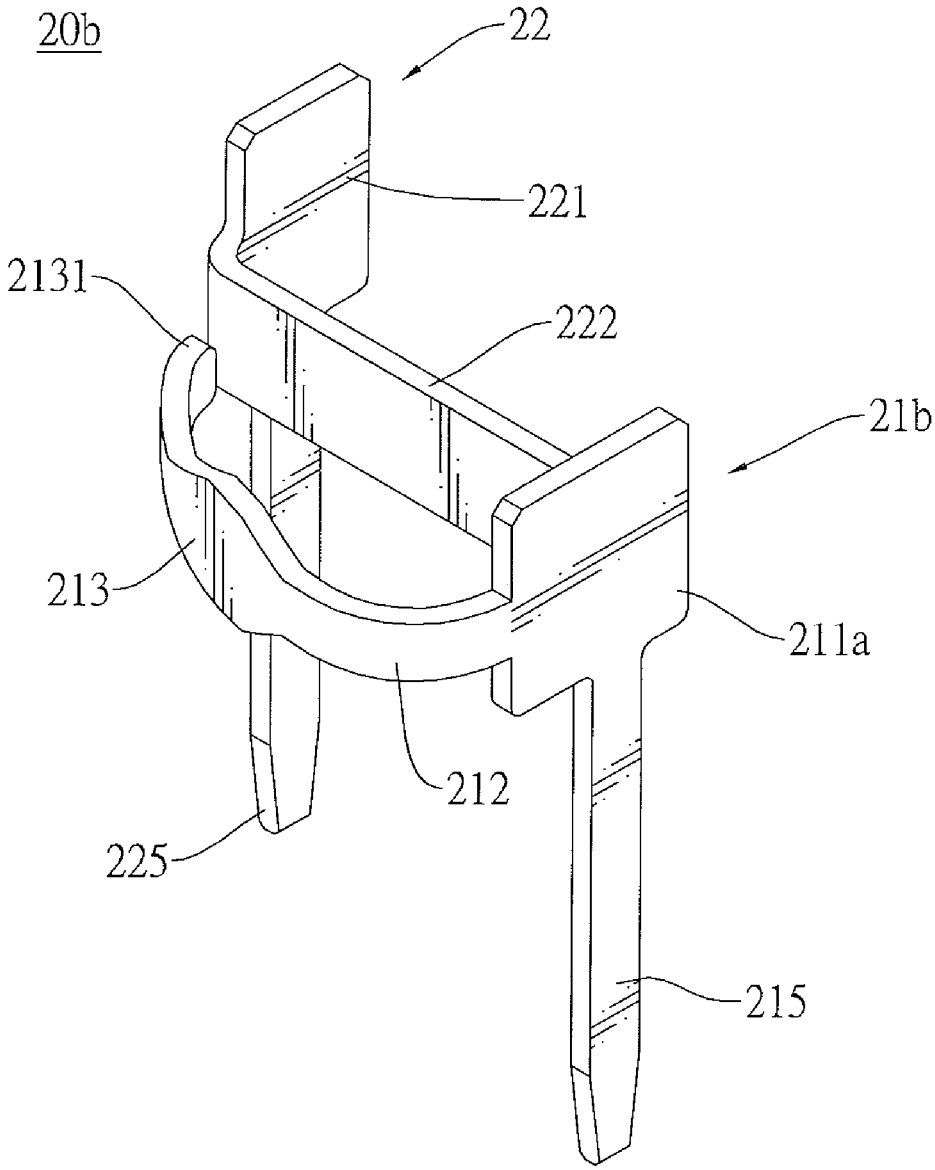
FIG. 7 is a perspective view of a plug detecting assembly of a third embodiment of a high frequency receptacle connector with a plug connector detecting function in accordance with the present invention.
Figure 8:
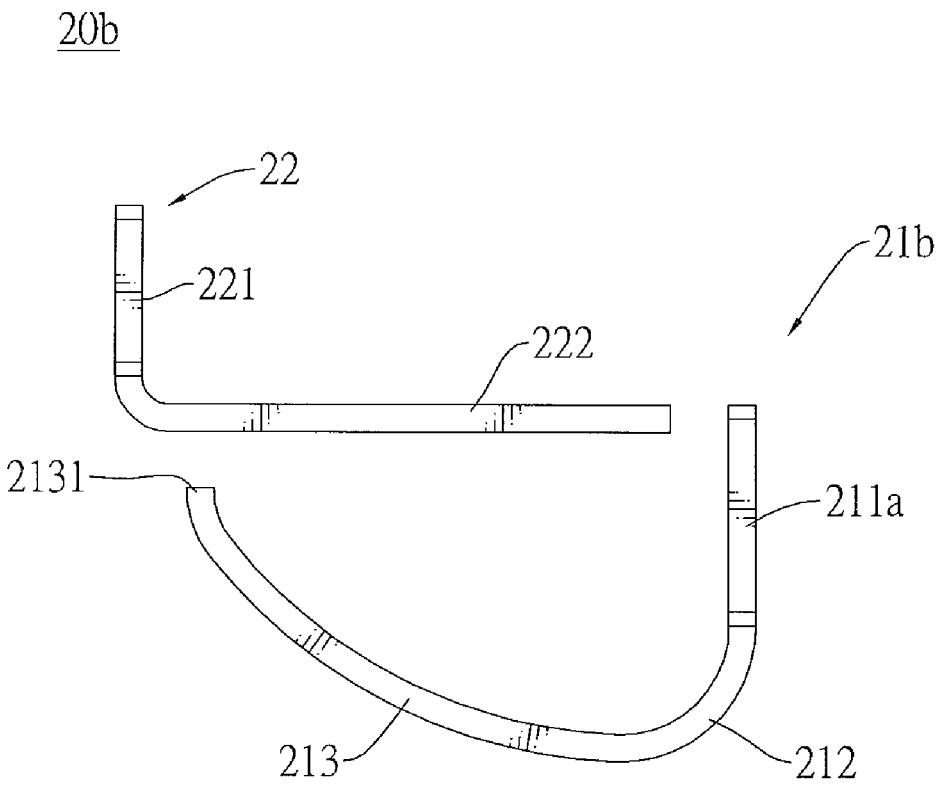
FIG. 8 is a top view of the plug detecting assembly of the high frequency receptacle connector in FIG. 7.

With further reference to FIGS. 7 and 8, a third embodiment of the high frequency receptacle connector in accordance with the present invention is similar to the second embodiment and modifies the second detecting terminal (21*b*) of the plug detecting assembly (20*b*). The resilient arm of the second detecting tab (21*b*) has a curved connecting tab (213). The curved connecting tab (213) has a contacting end (2131) selectively contacting the first contacting tab (222) at a contacting point. The resilient arm of the third embodiment omits the second contacting tab (214) when compared to the first and second embodiments so the material cost is reduced.

Figure 9:
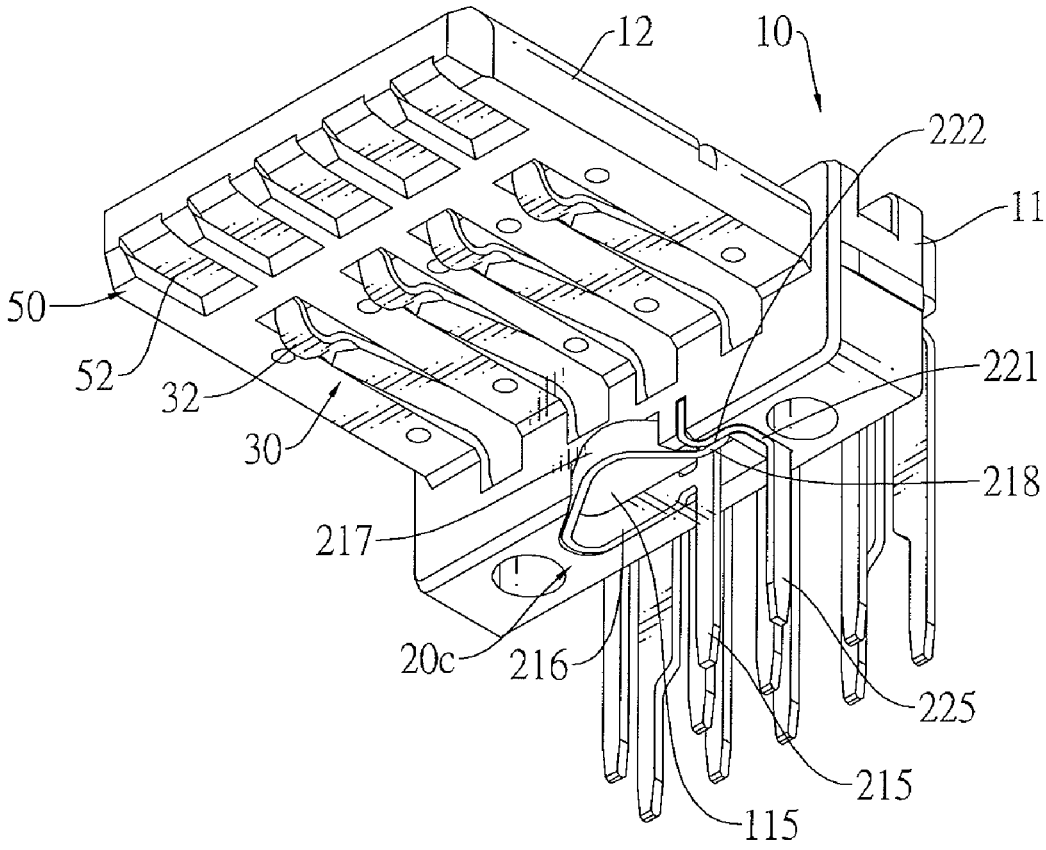
FIG. 9 is a bottom perspective view of a fourth embodiment of a high frequency receptacle connector with a plug connector detecting function in accordance with the present invention omitting the shell and the protecting bracket.
Figure 10:
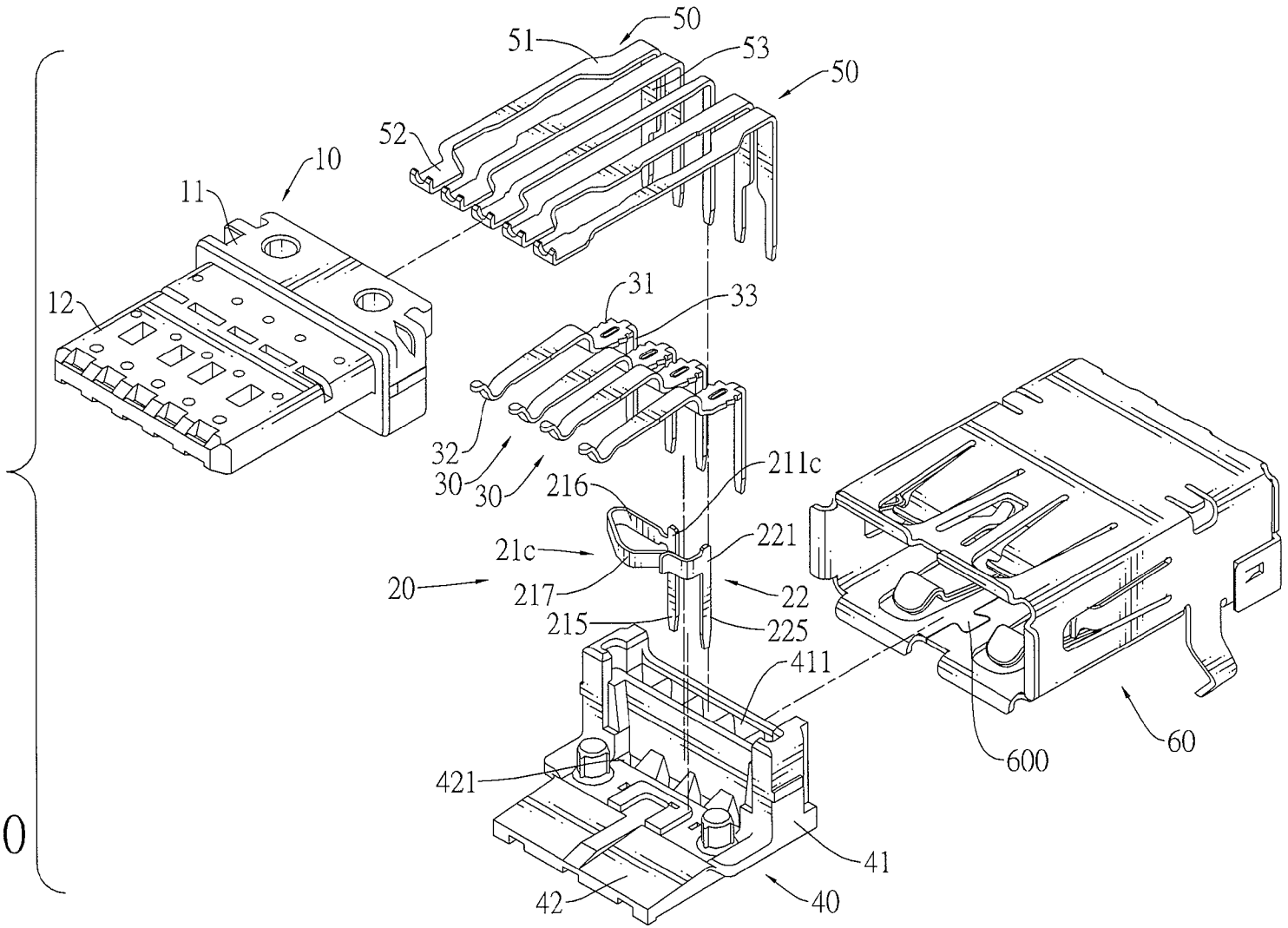
FIG. 10 is an exploded top perspective view of the high frequency receptacle connector in FIG. 9.
Figure 11:
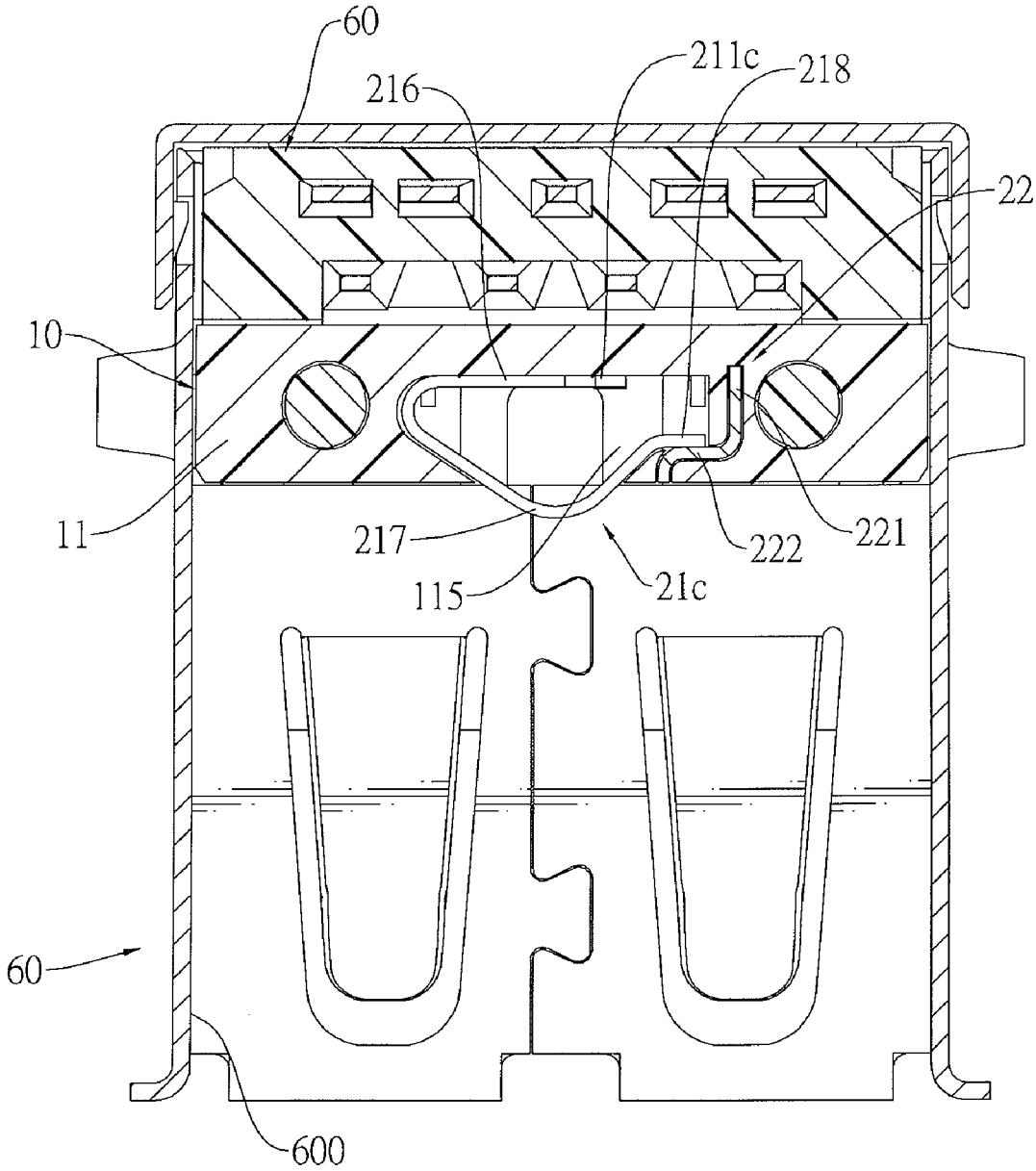
FIG. 11 is a cross sectional top view of the high frequency receptacle connector in FIG. 9.

With reference to FIGS. 9 to 11, a fourth embodiment of the high frequency receptacle connector in accordance with the present invention is similar to the first embodiment and modifies the plug detecting assembly (20*c*). The second detecting terminal (21*c*) is set in a predetermined configuration contacting the first detecting terminal (22) and is selectively pressed and bent to isolate and separate from the first detecting terminal (22) by external force.

The first detecting terminal (22) is L-shaped and has a first mounting tab (221) and a first contacting tab (222). The first mounting tab (221) is mounted and embedded securely in the base (11) of the insulating housing (10). The first contacting tab (222) is formed on and protrudes substantially perpendicularly from the first mounting tab (221) and is exposed out of the base (11).

The second detecting terminal (21*c*) is mounted in the mounting recess (115) of the base (11) and has a second mounting tab (211*c*), an extension tab (216), a resilient arm (217) and a second contacting tab (218).

The second mounting tab (211) is mounted in the mounting recess (115).

The extension tab (216) is formed on and protrudes transversely from the second mounting tab (211).

The resilient arm (217) is formed on the extension tab (216) and protrudes toward the first detecting terminal (22) and partially extends out of the mounting recess (115). The resilient arm (217) may be connected smoothly to the extension tab (216) so a connecting portion of the resilient arm (217) and the extension tab (216) is curved. Furthermore, the resilient arm (217) is substantially L-shaped and cooperates with the extension tab (216) to form a triangular configuration. A turning portion of the resilient arm (217) is curved and extends out of the mounting recess (115). The curved portions of the resilient arm (217) provide sufficient resilient force.

The second contacting tab (218) is formed on and protrudes from the resilient arm (217) and is located behind and contacts the first contacting tab (222). When a plug connector is inserted in the high frequency receptacle connector, an external force due to the insertion pushes the turning portion of the resilient arm (217) to bend inward into the mounting recess (115) to separate the second contacting tab (218) from the first contacting tab (222).

The high frequency receptacle connector may be mounted in a PCB such as a motherboard of a computer. At least one of the first and second terminals (30, 50) is a power terminal connected electrically to the plug detecting assembly (20, 20*a*, 20*b*, 20*c*). When a plug connector is inserted into the high frequency receptacle connector, the first detecting terminal (22) contacts or separates from the second detecting terminal (21, 21*a*, 21*b*, 21*c*). When the first detecting terminal (22) contacts the second detecting terminal (21, 21*a*, 21*b*, 21*c*), the PCB supplies or cuts off electric power to the power terminal. When the first detecting terminal (22) separates from the second detecting terminal (21, 21*a*, 21*b*, 21*c*), the PCB cuts off or supplies electric power to the power terminal. Therefore, the high frequency receptacle connector saves electric power when no plug connector is inserted. Furthermore, the high frequency receptacle connector may cooperate with the power-saving mode of the PCB to provide electronic devices such MP3 players and cellular phones with power when the computer is shut down.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A high frequency receptacle connector comprising:

an insulating housing;

multiple first terminals mounted on the insulating housing;

multiple second terminals mounted on the insulating housing and being capable of cooperating with the first terminals to implement USB 3.0 protocol;

a shell having a cavity defined through the shell and covering the insulating housing, the first terminals and the second terminals;

a plug detecting assembly mounted on the insulating housing and having a first detecting terminal mounted on the insulating housing; and a second detecting terminal being resilient and mounted on the insulating housing;

wherein the second detecting terminal selectively bends to contact or isolate from the first detecting terminal;

wherein the second detecting terminal is set in a predetermined configuration isolating and separating from the first detecting terminal and is selectively pressed and bent to contact the first detecting terminal by external force, wherein the insulating housing has a base having a front, a bottom and a mounting recess defined in the front; and a tongue formed on and protruding forward from the front of the base and having a bottom surface;

wherein the first detecting terminal is L-shaped and has a first mounting tab mounted in the base; and a first contacting tab formed on and protruding substantially perpendicularly from the first mounting tab and mounted in the mounting recess;

wherein the second detecting terminal has a second mounting tab mounted in the base;

a turning tab formed on the second mounting tab; and a resilient arm formed on and protruding from the turning tab, extending out of the base and selectively bending to contact the first contacting tab of the first detecting terminal;

wherein the first detecting terminal further has a first soldering tab formed on and protruding downward from the first mounting tab;

wherein the second detecting terminal further has a second soldering tab formed on and protruding downward from the second mounting tab; and wherein a protecting bracket is mounted on the bottom of the base of the insulating housing and has multiple through holes defined through the protecting bracket and respectively holding the first soldering sections, second soldering sections, first soldering tab and second soldering tab.

2. The high frequency receptacle connector as claimed in claim 1, wherein the resilient arm of the second detecting terminal has a curved connecting tab formed on the turning tab and having a contacting end selectively contacting the first contacting tab at a contacting point.

3. The high frequency receptacle connector as claimed in claim 2, wherein the turning tab of the second detecting terminal is curved.

4. The high frequency receptacle connector as claimed in claim 2, wherein the first mounting tab of the first detecting terminal and the second mounting tab of the second detecting terminal are located at a same embedded depth relative to the base of the insulating housing.

5. The high frequency receptacle connector as claimed in claim 2, wherein the first contacting tab of the first detecting terminal and the second mounting tab of the second detecting terminal are located at a same depth relative to the base of the insulating housing.

6. The high frequency receptacle connector as claimed in claim 1, wherein the resilient arm of the second detecting terminal has a connecting tab formed on the turning tab and protruding away from the second mounting tab; and a second contacting tab formed on the connecting tab and protruding toward the second mounting tab and selectively contacting the first contacting tab in a surface area.

7. The high frequency receptacle connector as claimed in claim 1, wherein each first terminal has a first mounting section mounted in the base of the insulating housing;

a first contacting section formed on and protruding forward from the first mounting section and mounted on the bottom surface of the tongue; and a first soldering section formed on and protruding downward from the first mounting section; and wherein each second terminal has a second mounting section mounted in the base of the insulating housing;

a second contacting section formed on and protruding forward from the second mounting section and mounted on the bottom surface of the tongue; and a second soldering section formed on and protruding downward from the second mounting section.

8. The high frequency receptacle connector as claimed in claim 1, wherein the multiple first terminals are capable of implementing USB 2.0 protocol.

9. A high frequency receptacle connector comprising:

an insulating housing;

multiple first terminals mounted on the insulating housing;

multiple second terminals mounted on the insulating housing and being capable of cooperating with the first terminals to implement USB 3.0 protocol;

a shell having a cavity defined through the shell and covering the insulating housing, the first terminals and the second terminals;

a plug detecting assembly mounted on the insulating housing and having a first detecting terminal mounted on the insulating housing; and a second detecting terminal being resilient and mounted on the insulating housing;

wherein the second detecting terminal selectively bends to contact or isolate from the first detecting terminal;

wherein the second detecting terminal is set in a predetermined configuration contacting the first detecting terminal and is selectively pressed and bent to isolate and separate from the first detecting terminal by external force, wherein the insulating housing has a base having a front, a bottom and a mounting recess defined in the front; and a tongue formed on and protruding forward from the front of the base and having a bottom surface;

wherein the first detecting terminal is L-shaped and has a first mounting tab mounted in the base; and a first contacting tab formed on and protruding substantially perpendicularly from the first mounting tab and exposed out of the base; and wherein the second detecting terminal is mounted in the mounting recess and has a second mounting tab mounted in the mounting recess;

an extension tab formed on and protruding transversely from the second mounting tab;

a resilient arm formed on the extension tab and protruding toward first detecting terminal and partially extending out of the mounting recess; and a second contacting tab formed on and protruding from the resilient arm, located behind and contacting the first contacting tab and selectively bending inward into the mounting recess to separate the second contacting tab from the first contacting tab.

10. The high frequency receptacle connector as claimed in claim 9, wherein the resilient arm is substantially L-shaped and cooperates with the extension tab to form a triangular configuration.

11. The high frequency receptacle connector as claimed in claim 10, wherein a turning portion of the resilient arm is curved and extends out of the mounting recess.

12. The high frequency receptacle connector as claimed in claim 9, wherein each first terminal has a first mounting section mounted in the base of the insulating housing;

a first contacting section formed on and protruding forward from the first mounting section and mounted on the bottom surface of the tongue; and a first soldering section formed on and protruding downward from the first mounting section; and wherein each second terminal has a second mounting section mounted in the base of the insulating housing;

a second contacting section formed on and protruding forward from the second mounting section and mounted on the bottom surface of the tongue; and a second soldering section formed on and protruding downward from the second mounting section.

13. The high frequency receptacle connector as claimed in claim 9, wherein the first detecting terminal further has a first soldering tab formed on and protruding downward from the first mounting tab; and the second detecting terminal further has a second soldering tab formed on and protruding downward from the second mounting tab.

14. The high frequency receptacle connector as claimed in claim 13 further comprising a protecting bracket mounted on the bottom of the base of the insulating housing and having multiple through holes defined through the protecting bracket and respectively holding the first soldering sections, second soldering sections, first soldering tab and second soldering tab.

* * * * *